United States Patent [19]

Hagewood et al.

[11] Patent Number: 4,924,567

[45] Date of Patent: May 15, 1990

[54] APPARATUS FOR CONTROLLING TENSION IN A TRAVELING YARN

[75] Inventors: John F. Hagewood, Matthews; Julius Darigo, Charlotte, both of N.C.

[73] Assignee: McCoy-Ellison, Inc., Monroe, N.C.

[21] Appl. No.: 252,497

[22] Filed: Sep. 30, 1988

[51] Int. Cl.[5] ..... B65H 59/00; D02H 13/14

[52] U.S. Cl. ..... 28/185; 242/75.5; 226/118

[58] Field of Search ..... 28/185, 186, 187; 226/118, 119; 242/75.5

[56] References Cited

U.S. PATENT DOCUMENTS

| | | | |
|---|---|---|---|
| 3,429,016 | 2/1969 | Bailey et al. | 28/185 |
| 3,502,535 | 3/1970 | Bongers et al. | 226/119 |
| 4,058,265 | 11/1977 | Hedlund et al. | 226/118 |
| 4,341,335 | 7/1982 | Schmid | 242/75.5 |

*Primary Examiner*—Werner H. Schroeder
*Assistant Examiner*—Jodi A. Tokar
*Attorney, Agent, or Firm*—Shefte, Pinckney & Sawyer

[57] ABSTRACT

Apparatus for controlling tension in a traveling yarn being delivered to a driven winding apparatus includes sequential yarn-engaging first and second idler rolls, one having a stationary rotational axis and the rotational axis of the other being movable in a defined path responsive to tension variations in the traveling yarn, a piston-and-cylinder biasing assembly for urging the movable roll into yarn tensioning engagement, and a potentiometer for sensing tension-responsive movement of the movable roll and operatively associated with the winding apparatus for varying its yarn winding speed to compensate for such tension variations. In one embodiment, the movable roll follows a horizontal path of movement and is spaced considerably from the stationary roll for functioning as a yarn accumulator. In a second embodiment, the movable roll pivots through an arcuate path of movement centered about the stationary roll.

11 Claims, 5 Drawing Sheets

FIG. 2
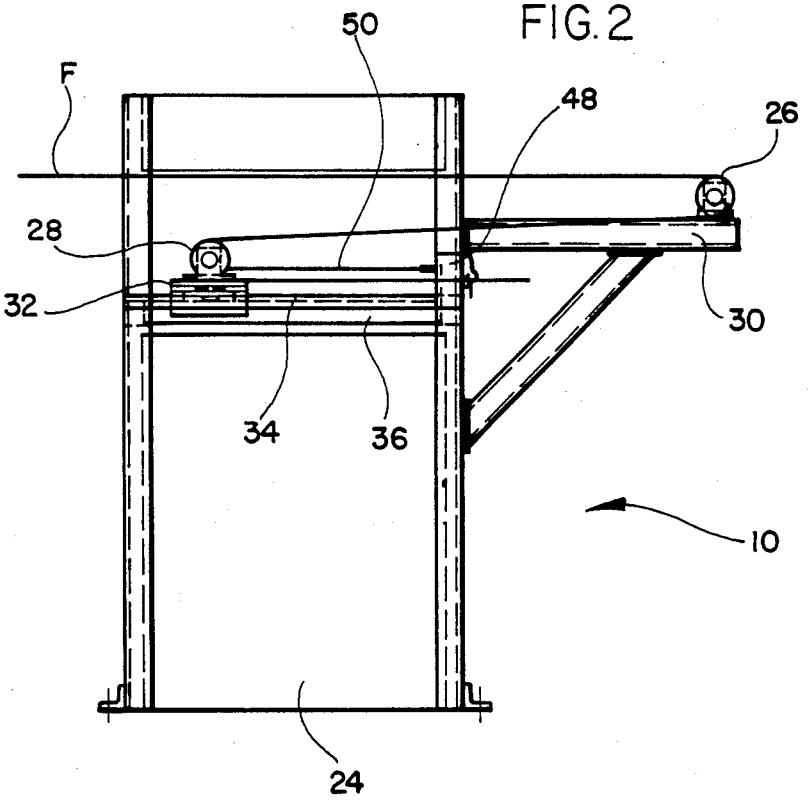
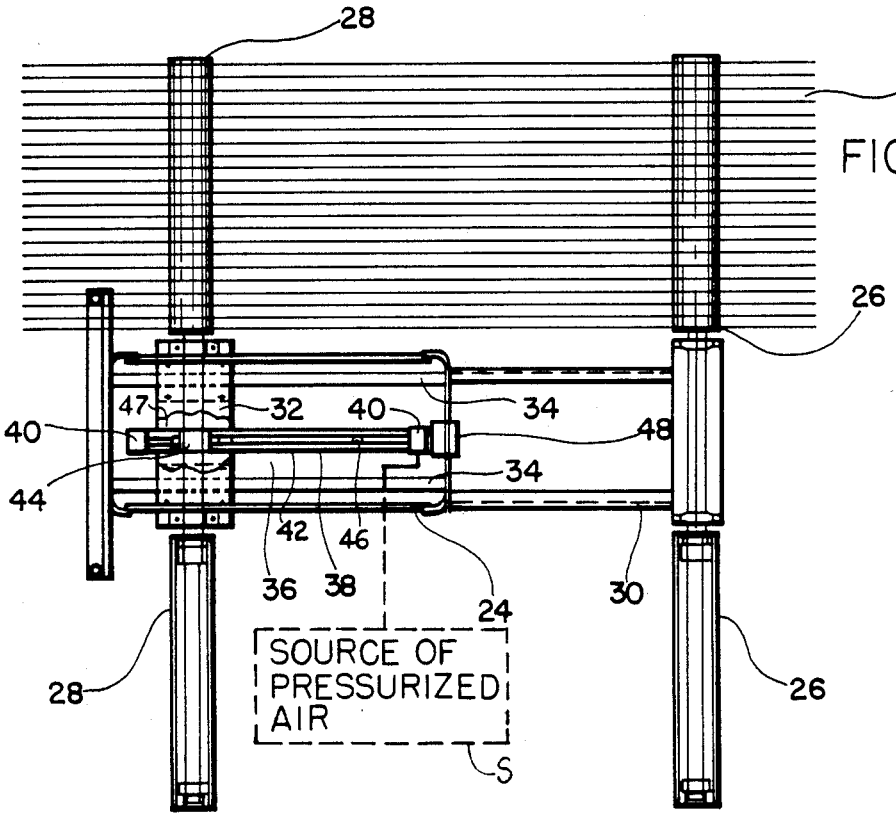
FIG. 3

APPARATUS FOR CONTROLLING TENSION IN A TRAVELING YARN

BACKGROUND OF THE INVENTION

The present invention relates generally to apparatus for controlling tension in a traveling yarn or the like and, more particularly, to such a yarn tension control apparatus adapted for disposition in a textile draw-warping system intermediate a drawing apparatus and a warp beaming machine.

In virtually all systems involving the handling of yarn and similar strand-like materials, it is a characteristic requirement that the tension conditions in the material be controlled in order to best insure high quality results. This is particularly true in the handling of traveling yarns in typical textile manufacturing systems. Conventionally, the control of yarn tension in such operations has been commercially achieved by imposing an essentially fixed restraint, drag or load exerting a frictional force on the advancing strand. Disadvantageously, tension control devices operating in this manner provide only moderate effectiveness in maintaining yarn tension within a desirable range and are essentially effective primarily in merely maintaining a minimum tension in the yarn. Specifically, the restraint imposed by such devices on the traveling yarn is effective to compensate for tension losses by maintaining a minimum restraint against yarn travel. However, such devices effectively magnify tension increases in the yarn, rather than compensating for and offsetting such fluctuations, which may sometimes result in yarn breakage.

In textile draw-warping systems, a plurality of continuous filaments of synthetic polymeric materials of the type suitable for use as textile yarns are fed generally in side-by-side relation to a drawing apparatus wherein the filaments are drawn longitudinally and heat set to align and order the molecular and crystalline structure of the filaments to a desired degree, following which the plural filaments are guided to a warp-beaming machine by which the filaments are wound side-by-side onto a spool or beam in preparation for subsequent feeding of the yarns to a weaving, warp-knitting or similar fabric-forming apparatus. As in any other warp-preparation operation within the textile industry, it is important that the individual filamentary yarns be wound onto the warp beam by the beaming machine at a substantially uniform tension. For this purpose, it is conventional to incorporate a tensioning mechanism of the above-described type in advance of the warp beaming machine for imposing a frictional drag on the drawn filamentary yarns as they enter the beaming machine.

Another consideration in the design of textile draw-warping systems is the periodic necessity of interrupting the normally continuous draw-warping operation, for example, when any one of the traveling filaments breaks or for other reasons experiences a significant loss in tension activating a stop motion arrangement of the draw-warping equipment. For economic reasons, it is desirable to operate draw-warping systems at an operating speed, i.e. the traveling speed of the filaments, as high as practicably possible. Thus, whenever stoppage of the draw-warping system is necessary, it is not practical or possible to effect immediate stoppage of the traveling filament movement. Accordingly, draw-warping systems are conventionally designed with the warp beaming machine spaced a sufficient distance from the stop motion arrangement in relation to the normal filament traveling speed and the rate at which the system is capable of braking to a complete stop so as to insure that system stoppages are completed in the event of a filament breakage before the broken filament or filaments are taken up by the warp beaming machine. As will be understood, this manner of construction substantially increases the overall length of draw-warping equipment which is considered highly disadvantageous by users because of the substantial floor space required.

SUMMARY OF THE INVENTION

It is accordingly an object of the present invention to provide an improved apparatus for controlling tension in a traveling yarn being delivered to a driven winding apparatus, such as in a textile draw-warping system, which avoids the disadvantages of the prior art. It is a specific object of the present invention to provide such a yarn tension controlling apparatus which imposes only a minimal fractional drag on the traveling yarn. It is a further object of the present invention to provide a yarn tension controlling apparatus which also functions to accumulate a significant length of the traveling yarn such that, when utilized in a draw-warping system, the present apparatus enables a significant reduction in the overall length of, and floor space required by, the draw-warping equipment.

Briefly summarized, the yarn tension controlling apparatus of the present invention is designed for use in delivering a traveling yarn to a driven winding apparatus. For this purpose, the present tension controlling apparatus includes first and second idler rolls arranged for training of the traveling yarn in series peripherally about the rolls. The first roll is rotatably mounted about a stationary axis for driven rotation by the traveling movement of the yarn. The second roll is rotatably mounted about an axis movable in a defined path with respect to the first roll for corresponding driven rotation by the traveling movement of the yarn and for movement also in opposite directions along the path in response to tension increases and decreases in the traveling yarn. A biasing arrangement is provided for applying a biasing force which is generally constant at each position of the second roll along its defined path for urging movement of the second roll in the path into tensioning engagement with the yarn. A sensing device is provided for detecting movement of the second roll in each direction along the path from a defined neutral point thereon. The sensing device is operatively associated with the driven winding apparatus for increasing its yarn winding speed in response to movement of the second roll in one direction responsive to a yarn tension decrease and for decreasing its yarn winding speed in response to movement of the second roll in the opposite direction responsive to a yarn tension increase.

Preferably, the sensing device is an electronic position transducer having a potentiometer arranged for sensing the degree of movement of the second roll from its neutral point and for actuating increases and decreases of the yarn winding speed of the winding apparatus to a corresponding degree sufficient to decrease and increase, respectively, the tension in the traveling yarn at the second roll to return it to its neutral point.

In one embodiment, the second roll is arranged for movement in a horizontal linear path parallel to the stationary axis of the first roll. Preferably, the first and second rolls are spaced horizontally from one another a sufficient distance for accumulation of a greater length of the traveling yarn between the source of its supply and the winding apparatus than the distance the yarn will travel during a stoppage of the apparatus at a predetermined normal rate of braking.

In a second embodiment, the second roll is arranged to move in an arcuate path centered about the stationary axis of the first roll, with the neutral point of the arcuate path preferably being generally vertically aligned with the stationary axis of the first roll for movement of the second roll from its neutral point with an at least initially predominantly horizontal component of movement.

In either embodiment, the second roll is preferably connected operably for movement with a piston disposed within a pressurized fluid cylinder for biasing of the second roll as aforementioned.

BRIEF DESCRIPTION OF THE DRAWINGS

FIG. 2 is a more enlarged and detailed side elevational view of the present yarn tension controlling apparatus of FIG. 1;

FIG. 3 is a top plan view of the yarn tension controlling apparatus of FIG. 2;

DESCRIPTION OF THE PREFERRED EMBODIMENT

Figure 1:
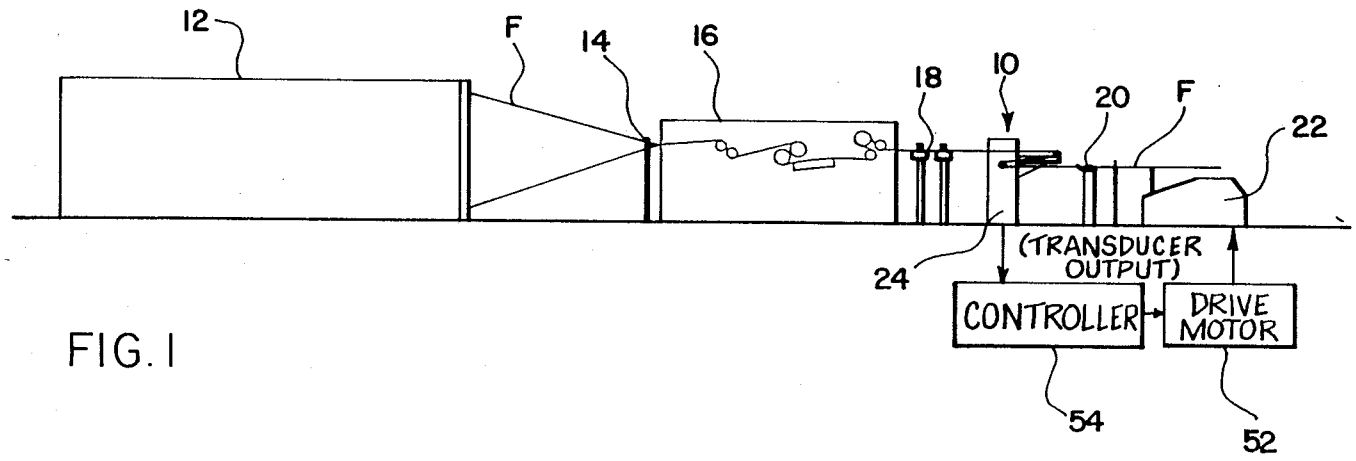
FIG. 1 is a schematic side elevational view of a draw-warping system incorporating the preferred embodiment of the yarn tension controlling apparatus of the present invention.

Referring now to the accompanying drawings and initially to FIG. 1, a yarn tension controlling apparatus according to the preferred embodiment of the present invention is shown generally at 10 as preferably embodied in a draw-warping system wherein a creel, representatively indicated at 12, supports a plurality of individual packages of partially oriented synthetic continuous filaments, such as polyester or nylon, which are fed as represented at F generally in side-by-side relation through an eyeboard 14 to a drawing apparatus 16 and travel therefrom through a filament inspecting device 18, the tension controlling apparatus 10, and an oiling device 20, to warp beaming machine 22, commonly referred to as a warper. While the present yarn tension controlling apparatus 10 is herein illustrated and described in its preferred use as part of the described draw-warping system, such description is only for purposes of illustration in order to provide an enabling disclosure of the best mode of the present invention. Those persons of skill in the art will readily recognize that the present yarn tension controlling apparatus 10 is of a broad utility and is therefore susceptible of many other applications and embodiments whenever it is desired to control the tension in a traveling yarn being delivered to a driven winding apparatus. In this regard, the use of the term "yarn" herein is intended to generically encompass substantially any continuous length textile material, e.g. the filaments F.

Figure 4:
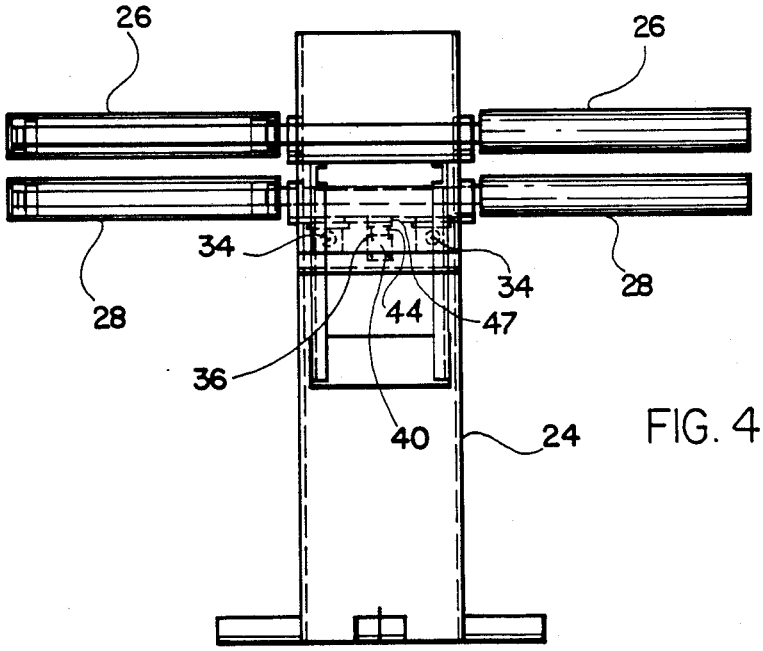
FIG. 4 is an end elevational view of the yarn tension controlling apparatus of FIG. 2.

The present yarn tension controlling apparatus 10 is shown in greater detail in FIGS. 2, 3 and 4. Basically, the tension controlling apparatus 10 has an upstanding central frame 24 by which a pair of idler rolls 26, 28 are rotatably supported to extend outwardly in cantilevered fashion from each opposite side of the frame 24 for training of the filaments F in sequence peripherally about the rolls 26, 28, as shown. This construction facilitates operator access to the filaments F for ease of filament thread-up and like operations. The first idler roll 26 is mounted in a fixed disposition for rotation about a stationary axis at the forward end of a shelf 30 which projects forwardly from the frame 24. The second idler roll 28 is rotatably mounted at a slightly lower elevation than the first idler roll 26 on a movable shelf 32 supported within the frame 24 on a pair of guide rods 34 fixed to the frame to extend horizontally in parallel relation to one another and to the path of travel of the filaments F, whereby the axis of rotation of the second idler roll 28 is movable toward and away from the first idler roll 26 in a substantially horizontal path.

A piston-and-cylinder assembly 36 is mounted within the frame 24 intermediate and in parallel relation with the guide rods 34 immediately beneath the movable shelf 32. The piston-and-cylinder assembly 36 basically includes a cylindrical housing 38 containing a reciprocable piston (not shown) dividing the housing interior into two operating chambers at opposite sides of the piston, with fittings 40 being fixed at opposite ends of the housing 38 for admitting and exhausting pressurized operating fluid, preferably pressurized air, into and from the respective chambers. A longitudinal slot 42 is formed in the upwardly facing surface of the cylindrical housing 38 through which a slide member 44 disposed exteriorly of the housing 38 is connected to the piston for sliding movement therewith along the slot 42, a sealing band 46 extending from each opposite end of the slide member 44 in slidable sealing relationship with the slot 42 for sliding movement with the slide member 44 to sealingly close the remaining extent of the slot 42. A clevis 47 affixed to the underside of the movable shelf 32 is attached to the slide member 44 for unitary movement of the movable shelf 32 and the second idler roll 28 with the slide member 44 and the piston. Piston-and-cylinder assemblies of the described type are known and commercially available and, accordingly, need not be more fully described herein.

An electronic position transducer 48 is mounted at the forward end of the frame 24 in line with the piston-and-cylinder assembly 36. The transducer 48 is of the type having a potentiometer (not shown) to which an extendable and retractable cable 50 is operatively connected, the extending free end of the cable 50 being attached to the movable shelf 32 immediately beneath the idler roll 28 whereby the potentiometer is enabled to monitor the position of the second idler roll 28 in its horizontal path of travel and, in turn, to produce a variable voltage output as a function of the degree to which the cable 50 is withdrawn from the transducer housing 48.

As will thus be understood, as the filaments F travel in series peripherally about the first and second idler rolls 26, 28, the traveling movement of the filaments F drives rotation of the rolls 26, 28. The forwardmost fitting 40 of the piston-and-cylinder assembly 36 is supplied with pressurized air from a suitable source of supply, representatively indicated at S, to apply a biasing force urging movement of the second roll 28 within its horizontal path of movement away from the first idler roll 26 to maintain the second roll 28 in engagement with the filaments F. As will be understood, the biasing force exerted by the piston-and-cylinder assembly 36 on the second idler roll 28 is essentially constant at each position of the roll 28 along its horizontal path of movement, the amount of the biasing force being selected to be substantially equivalent to the desired amount of tension in the traveling filaments F whereby the prevailing filament tension counteracts the biasing force. So long as the tension prevailing in the filaments F remains constant at the desired tension level, the second idler roll 28 will not move within its horizontal path of movement either toward or away from the first idler roll 26. However, if the prevailing tension in the filaments F increases, the increased filament tension overcomes the biasing force to cause the second idler roll 28 to move along its path of movement toward the stationary idler roll 26. Likewise, in the event of a decrease in the prevailing tension in the filaments F, the biasing force overcomes the prevailing filament tension to cause the second idler roll 28 to move away from the first idler roll 26. Correspondingly, the cable 50 is retracted within or withdrawn from the transducer housing whereby the voltage output from the transducer 48 changes to a degree corresponding to the degree of movement of the second idler roll 28.

As representatively shown in FIG. 1, the warp beaming machine 22 has a variable speed drive motor which drives the axial shaft of a warp beam (not shown) on which the filaments F are wound. The operational speed of the drive motor 52 is controlled by a programmable microprocessor 54 or other suitable controller. For example, as is known, the driven speed of the warp beam must be progressively reduced as the diameter of the wound filaments F increases over the course of the beaming operation so as to maintain the peripheral take-up speed of the warp beam substantially constant. According to the present invention, the variable voltage output of the transducer 48, representing movement of the second idler roll 28 toward and away from the first idler roll 26 in response to increases and decreases, respectively, in the prevailing tension in the filaments F, is supplied to the microprocessor 54 and the microprocessor 54 is programmed to correspondingly vary the driven axial speed of the warp beam to compensate for such tension fluctuations. Specifically, assuming the prevailing tension in the traveling filaments F remains constant at a predetermined desired amount of tension, the second idler roll 28 should assume and not move from a corresponding "neutral" position intermediately along its horizontal path of movement. The microprocessor 54 is programmed to control the drive motor 52 to increase the driven axial speed of the warp beam to a sufficient degree in response to recognition by the transducer 48 of movement of the second idler roll 28 from the neutral position in a direction away from the first idler roll 26 to compensate for the amount of the thusly-indicated decrease in the filament tension as a function of the degree of such movement of the second idler roll 28 represented by the amount of change in the voltage output of the transducer 48, thereby to reduce the idler roll 28 to its neutral position. Conversely, the microprocessor 54 is similarly programmed to operate the drive motor 52 to decrease the driven axial speed of the warp beam to a sufficient degree in response to recognition by the transducer 48 of movement of the second idler roll 28 from its neutral position in a direction toward the first idler roll 26 to compensate for the amount of the thusly-indicated increase in the tension in the filaments F as function of the degree of such movement of the second idler roll 28 represented by the amount of change in the voltage output of the transducer 48, thereby to reduce the idler roll 28 to its neutral position. Variation of the driven speed of the warp beam in this manner serves to maintain the filament tension substantially constant and, in turn, maintain the second idler roll 28 essentially at its predetermined neutral location.

Figure 5:
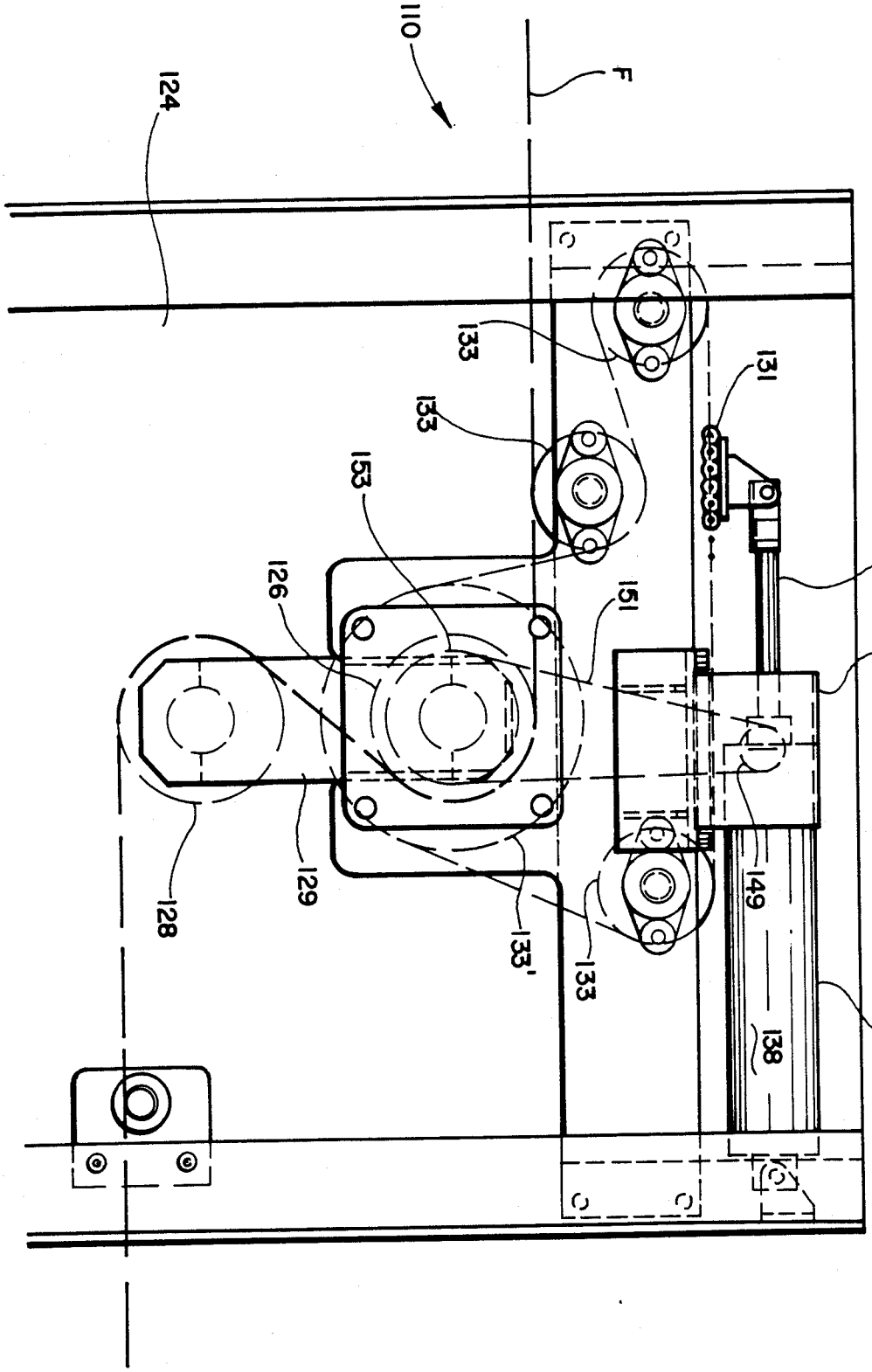
FIG. 5 is a side elevational view of an alternate embodiment of the yarn tension controlling apparatus of the present invention.
Figure 6:
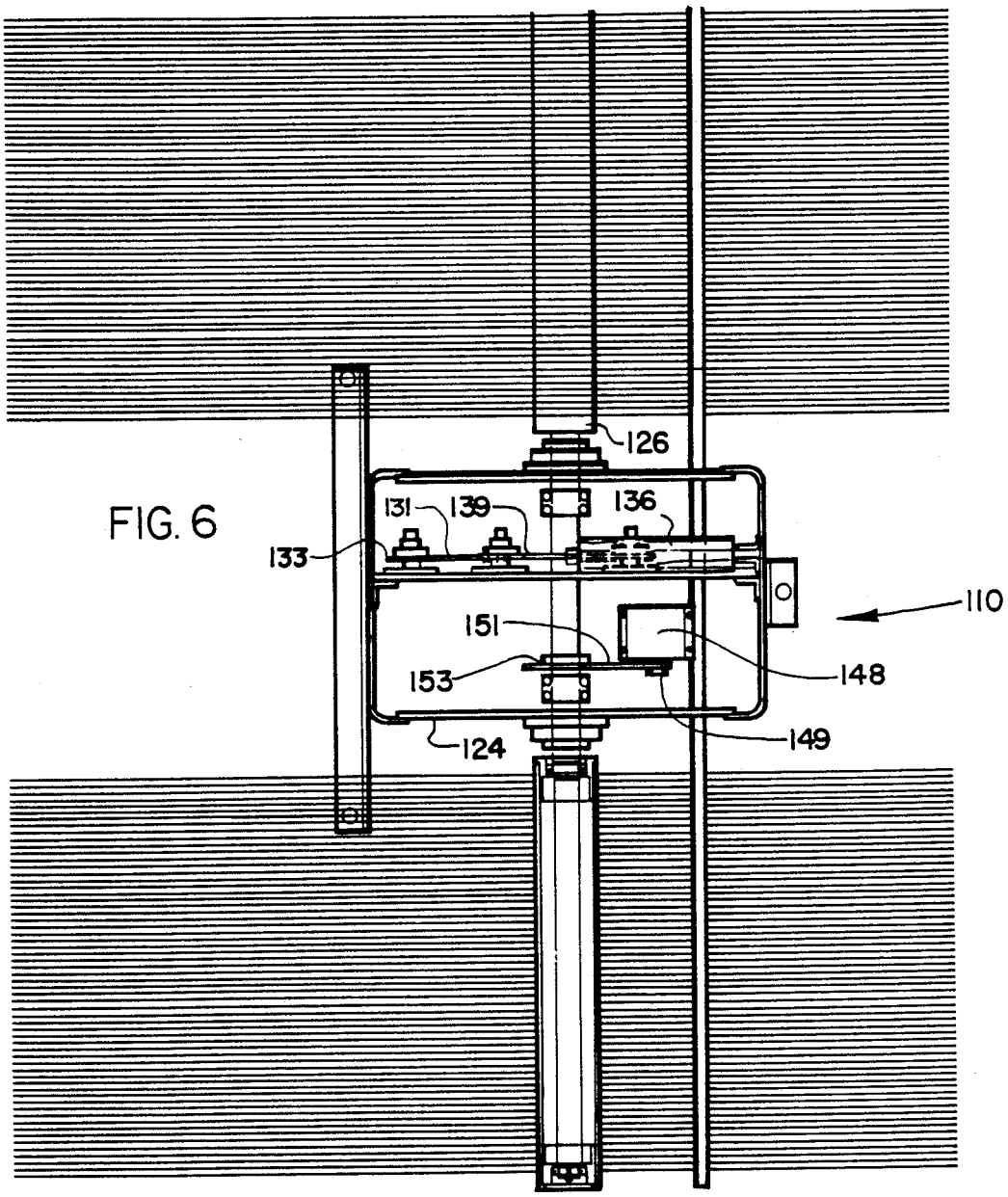
FIG. 6 is a top plan view of the yarn tension controlling apparatus of FIG. 5.

With reference now to FIGS. 5 and 6, an alternate embodiment of the yarn tension controlling apparatus of the present invention is indicated generally at 110. The tension controlling apparatus 110 has an upstanding central frame 124 by which a pair of idler rolls 126, 128 are rotatably supported in outwardly extending cantilevered fashion from each opposite side of the frame 124 for training of the synthetic continuous filaments F in sequence peripherally about the rollers 126, 128. The first idler roll 126 is mounted generally centrally of the frame 124 for rotation about a stationary axis, the second idler roll 128 being supported below the idler roll 126 at the free end of a depending arm assembly 129 pivotably supported at its opposite end coaxially with the stationary idler roll 126. An endless timing chain 131 is trained about a series of toothed pulleys 133 rotatably mounted interiorly within the frame 124, one of the pulleys 133' being fixed coaxially with the pivot arm assembly 129 for integral rotation therewith. A piston-and-cylinder assembly 136 is mounted horizontally within the frame 124 alongside the upper horizontal run of the endless chain 131, with the cylindrical housing 138 of the piston-and-cylinder assembly 136 being fixed with respect to the frame 124 and with an operating arm 139 of the piston projecting rearwardly from the cylindrical housing 138 and being fixed to the upper run of the endless chain 131. The housing 138 of the piston-and-cylinder assembly 136 is provided with fittings at its opposite ends for admitting and exhausting operating fluid, e.g. pressurized air, into and from interior chambers at opposite sides of the piston. An electronic position potentiometer 148 is also mounted within the frame 124 and has a rotatable operating shaft 149 with an endless belt 151 being trained peripherally about the operating shaft 149 and about a pulley 153 mounted coaxially with the pivot axis of the arm assembly 129 for rotating integrally with the arm assembly 129 and with the pulley 133'.

In operation, filaments F are trained in series peripherally about the idler rolls 126, 128 for driving rotation thereof by the traveling movement of the filaments F. Pressurized air is supplied to the rearward chamber of the piston-and-cylinder assembly 136 to apply a substantially constant biasing force urging retraction of the piston arm 139 and, in turn, urging pivotal movement of the arm assembly 129 and the second idler roll 128 as a unit in a clockwise direction (as viewed in FIG. 5) for engaging the second idler roll 128 with the traveling filaments F. The amount of the biasing force thusly exerted by the piston-and-cylinder assembly 136 is set at the predetermined level of tension desired in the filaments F so that, so long as the filament tension remains constant at such predetermined amount, the biasing force will exactly counteract the filament tension to maintain the second idler roll 128 substantially stationary vertically below the first idler roll 126. However, in the event the tension in the filaments F decreases below the predetermined tension level, the biasing force of the piston-and-cylinder assembly 136 will cause the arm assembly 129 and the second idler roll 128 to pivot in a clockwise direction (as viewed in FIG. 5), in turn rotating the pulley 153 to drive corresponding rotation of the operating shaft 149 of the potentiometer 148 through the belt 151. In like manner, increases in the filament tension above the desired amount overcome the biasing force of the piston-and-cylinder assembly 136 to produce counterclockwise pivoting of the arm assembly 129 and the second idler roll 128 to produce opposite rotation of the potentiometer's operating shaft 149. As in the first embodiment, the potentiometer 148 produces a variable voltage output in relation to the rotational disposition of its operating shaft 149, with the output being supplied to a controller, such as the microprocessor 54, for producing corresponding changes in the driven speed of a downstream winding apparatus, such as the warp beaming machine 22.

As will thus be understood, the yarn tension controlling apparatus of the present invention provides several important advantages. Most fundamentally, the present apparatus in both described embodiments provides a reliable means for maintaining a constant tensioning of a traveling yarn while being delivered to a driven winding apparatus, e.g., a plurality of traveling filaments being delivered to a warp beaming machine in a textile draw-warping system. Notably, by use of a piston-and-cylinder assembly in each embodiment for biasing the movable idler roll, the biasing force exerted is substantially constant at each position of the movable roll within the full range of its defined path of movement. By setting the biasing force at the desired yarn tension level and varying the driven speed of the warp beaming machine in response to sensed tension fluctuations, the present apparatus advantageously imposes a minimal added frictional drag on the traveling movement of the filaments or other yarn or yarns.

The first embodiment of FIGS. 2–4 provides the particular advantage of enabling the first and second idler rolls to be spaced a sufficient distance horizontally with respect to one another to function to accumulate a greater length of the traveling filaments between the drawing apparatus 10 and the warp beaming machine 22 than the distance the filaments will travel during a stoppage of the apparatus from its full normal operating speed at a predetermine normal rate of braking. As those persons skilled in the art will recognize, this capability is particularly important in winding operations such as conventional draw-warping systems which operate at relatively high yarn traveling speeds. In conventional draw-warping systems, the warp beaming machine is placed at a sufficient distance from the drawing apparatus to accommodate the braking of the traveling filaments in the event of a system stoppage. In contrast, the ability of the present apparatus to accumulate within itself substantially the same length of filaments enables a draw-warping system utilizing the present tension controlling apparatus to be of a substantially lesser overall length. Further, the mounting of the movable idler roll for horizontal travel insures a uniform gravitational affect on the roll throughout the full range of movement.

With respect to the second embodiment of FIGS. 5 and 6, the mounting of the movable idler roll for pivoting concentrically about the rotational axis of the stationary idler roll provides a novel self-dampening of pivotal movements of the movable idler roll. Specifically, as will be understood with reference to FIG. 5, clockwise pivoting of the movable idler roll about the stationary idler roll in response to yarn tension decreases naturally produces an increasing angular degree of filament wrapping about the pivoting roll which, in turn, produces a correspondingly increasing resistance to further clockwise pivoting movement of the roll. Conversely, counterclockwise pivoting movement of the movable roll about the stationary roll in response to yarn tension increases produces a decreasing angular degree of filament wrapping about the pivoting roll to correspondingly decrease resistance to further pivoting movement of the roll.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. Apparatus for controlling tension in a traveling yarn being delivered to a driven winding apparatus, comprising a first idler roll and a second idler roll arranged for training of the traveling yarn in series peripherally about said rolls, said first roll being rotatably mounted about a stationary axis for driven rotation by the traveling movement of the yarn and said second roll being rotatably mounted about an axis movable in a defined path with respect to said first roll for corresponding driven rotation by the traveling movement of the yarn and for movement in opposite directions along said path in response to tension increases and decreases in the traveling yarn, means for applying a biasing force for urging movement of said second roll in said path into tensioning engagement with the yarn, said biasing force being generally constant at each position of said second roll along said path and means for sensing movement of said second roll in each direction along said path from a defined neutral point thereon, said sensing means being operatively associated with said driven winding apparatus for increasing its yarn winding speed in response to movement of said second roll in one direction responsive to a yarn tension decrease and for decreasing its yarn winding speed in response to movement of said second roll in the opposite direction responsive to a yarn tension increase.

2. Tension controlling apparatus according to claim 1 and characterized further in that said sensing means is arranged for sensing the degree of movement of said second roll from said neutral point and for actuating increases and decreases of the yarn winding speed of said winding apparatus to a corresponding degree sufficient to decrease and increase, respectively, the tension in the traveling yarn at said second roll to return said second roll to said neutral point.

3. Tension controlling apparatus according to claim 2 and characterized further in that said sensing means comprises an electronic position transducer.

4. Tension controlling apparatus according to claim 3 and characterized further in that said transducer comprises a potentiometer.

5. Tension controlling apparatus according to claim 1 and characterized further in that said rolls are spaced from one another sufficiently to provide an accumulation of the traveling yarn between its source of supply and said winding apparatus.

6. Tension controlling apparatus according to claim 1 and characterized further in that said defined path of said second roll is a horizontal linear path parallel to said stationary axis of said first roll.

7. Tension controlling apparatus according to claim 6 and characterized further in that said first and second rolls are spaced horizontally from one another a sufficient distance for accumulation of a greater length of the traveling yarn between the source of its supply and said winding apparatus than the distance the yarn will travel during a stoppage of the apparatus at a predetermined normal rate of braking.

8. Tension controlling apparatus according to claim 6 and characterized further in that said second roll is operatively connected for movement with a piston disposed within a fluid cylinder.

9. Tension controlling apparatus according to claim 1 and characterized further in that said defined path of said second roll is an arcuate path centered about said stationary axis of said first roll.

10. Tension controlling apparatus according to claim 9 and characterized further in that said neutral point of said arcuate path is generally vertically aligned with said stationary axis of said first roll for movement of said second roll from said neutral point with an at least initially predominantly horizontal component of movement.

11. Tension controlling apparatus according to claim 9 and characterized further in that said second roll is operatively connected for movement with a piston disposed within a pressurized fluid cylinder.

* * * * *